United States Patent [19]

Walter

[11] 4,301,744

[45] Nov. 24, 1981

[54] TABLE SLIDE DEVICE

[75] Inventor: Thomas G. Walter, Wabash, Ind.

[73] Assignee: B. Walter & Company, Inc., Wabash, Ind.

[21] Appl. No.: 131,882

[22] Filed: Mar. 20, 1980

[51] Int. Cl.[3] ..... A47B 1/04; A47B 1/10

[52] U.S. Cl. ..... 108/77; 108/78

[58] Field of Search ..... 108/78, 77, 80; 308/3.6; 312/333, 330; 248/420

[56] References Cited

U.S. PATENT DOCUMENTS

| | | | |
|---|---|---|---|
| 2,685,488 | 8/1954 | Duncan | 108/78 |
| 2,731,317 | 1/1956 | Duncan | 108/78 |
| 3,336,881 | 8/1967 | Aiken, Sr. | 108/77 |
| 3,519,315 | 7/1970 | Campbell | 308/3.6 |
| 3,637,268 | 1/1972 | Walter | 308/3.6 |
| 3,876,263 | 4/1975 | Oleksiak | 108/83 |

FOREIGN PATENT DOCUMENTS

| | | | |
|---|---|---|---|
| 392770 | 10/1908 | France | 108/78 |

*Primary Examiner*—James T. McCall

*Attorney, Agent, or Firm*—Robert G. Irish

[57] ABSTRACT

A slide device for supporting the folding leaf of a drop-leaf table comprises a bar and an elongated retainer having a channel which receives the bar for lengthwise reciprocation. The channel has a depth slightly greater than the width of the bar, and the retainer is provided with oppositely extending coplanar flanges on opposite sides of the channel which define a substantially flat mounting surface. A first boss is provided on each flange near one end which projects above the mounting surface. A second boss of substantially the same height as the first boss is also provided on each flange and is disposed adjacent to the first boss on the side thereof toward the other flange end. Each second boss has a first mounting hole therethrough, and each flange is provided with a second mounting hole near the other end thereof.

9 Claims, 7 Drawing Figures

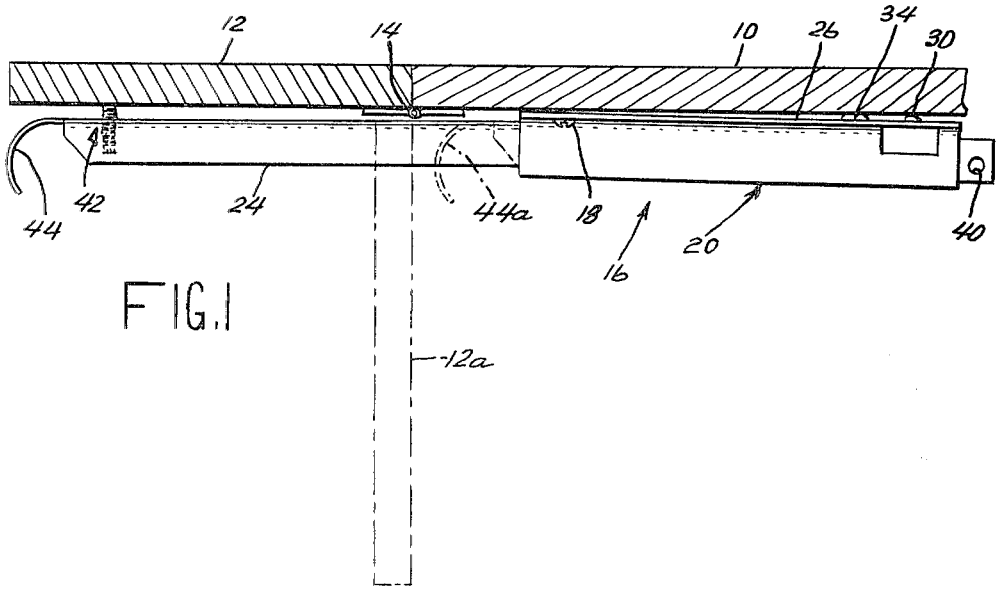
FIG.1
FIG.2
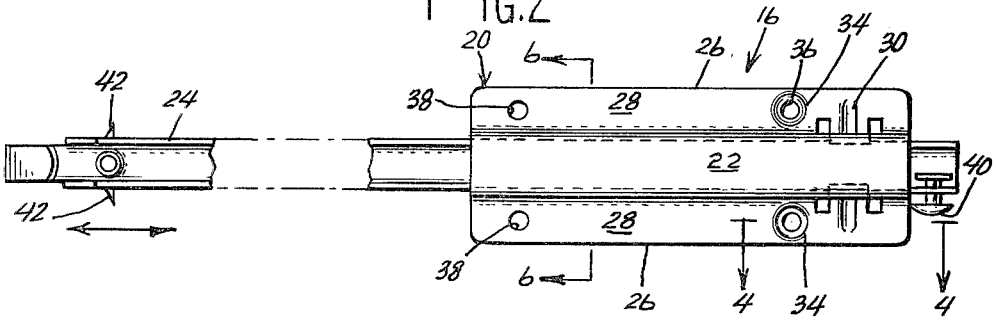
FIG.3
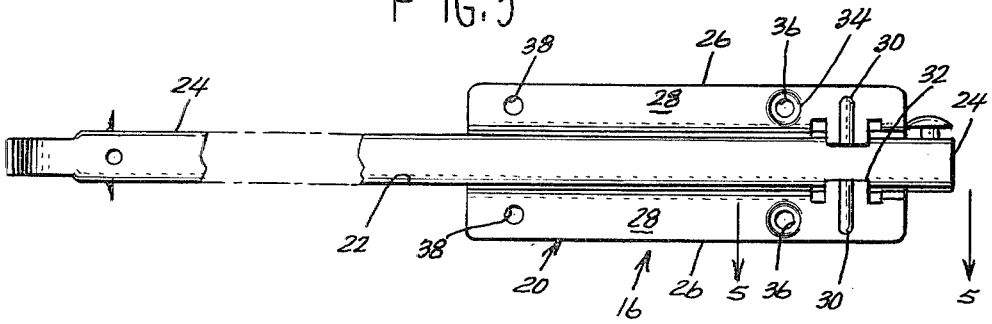

TABLE SLIDE DEVICE

BACKGROUND OF THE INVENTION

1. Field of the Invention

The invention relates to a support for drop leaves of tables and more particularly to a slide device conveniently manipulable to hold a drop leaf in elevated position.

2. Description of the Prior Art

Typical prior art structures are disclosed in U.S. Patent Nos.

U.S. Pat. No. 189,197
U.S. Pat. No. 135,827
U.S. Pat. No. 264,886
U.S. Pat. No. 444,191
U.S. Pat. No. 1,993,787
U.S. Pat. No. 3,336,881
U.S. Pat. No. 1,382,983
U.S. Pat. No. 1,651,825
U.S. Pat. No. 1,798,786
U.S. Pat. No. 2,210,220
U.S. Pat. No. 2,458,627
U.S. Pat. No. 2,685,488

Certain of these disclose arrangements for adjusting the slide so that the drop leaf, when raised, is substantially flush with the stationary table top. Also, certain of these reveal the use of an elongated bar serving as the slide which may be reciprocated between two different positions, one for supporting the drop leaf flush with the table top and the other for permitting the drop leaf to hang downwardly about its hinged connection with the table top. None of these, however, disclose any means for providing permanent inclination of a retainer for the slide which serves in positioning the bar upwardly when it is extended into leaf-supporting position for assuring that the leaf is maintained flush with the table top.

SUMMARY OF THE INVENTION

This invention pertains to a slide device for supporting the folding leaf of a drop-leaf table comprising a bar and an elongated retainer having a channel which receives the bar for lengthwise reciprocation. The channel has a depth slightly greater than the width of the bar. The retainer is provided with oppositely extending coplanar flanges on opposite sides of the channel which define a substantially flat mounting surface. A first boss on each flange near one end thereof projects above the mounting surface as does a second boss of substantially the same height, the second boss being disposed adjacent to the first boss but on the side thereof toward the other end of the flange. Each second boss is provided with a first mounting hole therethrough, a second mounting hole being provided in each flange near the other end thereof. Means are provided for retaining the bar assembled to the retainer, such means including inward extensions on the flanges which at least partially overlie the bar. Abutments are provided on the opposite ends, respectively, of the bar for engagement with the respective retainer ends thereby to prevent the bar from sliding out of the retainer.

It is an object of this invention to provide a manually operable slide device for a drop-leaf table, which is of strong and durable construction, provides positive support for the drop leaf in a position flush with the table top, and is economical to produce.

The above-mentioned and other features and objects of this this invention and the manner of attaining them will become more apparent and the invention itself will be best understood by reference to the following description of an embodiment of the invention taken in conjunction with the accompanying drawings.

In the drawings

FIG. 1 is a partial cross section of a typical drop leaf table with a slide device of this invention mounted thereon;

FIG. 2 is a bottom view of the slide device;

FIG. 3 is a top plan view thereof;

Figure 4:
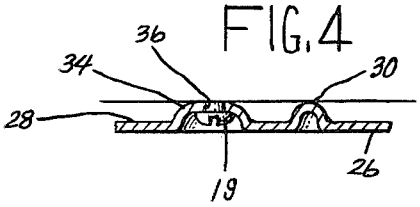
FIG. 4 is a sectional view taken substantially along section line 4—4 of FIG. 2.
Figure 5:
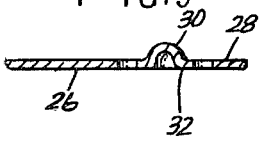
FIG. 5 is a similar sectional view taken substantially along section line 5—5 of FIG. 3.

Referring to the drawings, a conventional table is shown as having a stationary table top 10 and a conventional dropleaf 12 connected thereto by means of a hinge 14. By reason of the hinge mounting, the leaf 12 can be elevated to its illustrated position flush with the stationary table top 10 or swung downwardly to the dashed-line position indicated by the reference numeral 12*a*.

Figure 6:
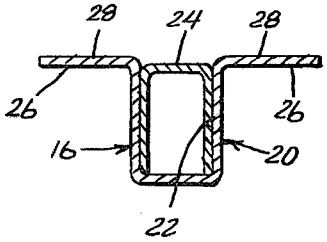
FIG. 6 is a cross section taken substantially along section line 6—6 of FIG. 2.
Figure 7:
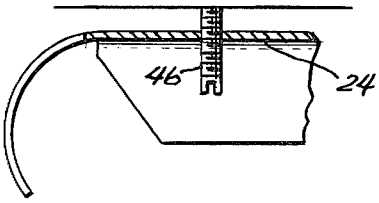
FIG. 7 is a fragmentary sectional view of the end portion of the slide bar of the device of the preceeding figures but with a screw adjustment provided thereon.

A slide device of this invention indicated generally by the reference numeral 16, is secured to the underside of the table top 10 by means of threaded fasteners 18 and 19 as explained in more detail hereafter. The slide device 16 includes an elongated retainer 20 of sheet metal formed to provide an elongated channel 22 which slidably receives for reciprocation a slide bar 24. The bar 24 may also be formed of sheet metal and in cross section is substantially U-shaped and generally rectangular to complement the shape of the channel 22. The channel 22, as shown more clearly in FIG. 6, is made to a depth just slightly greater than the width of the bar 24.

The retainer 20 has two outwardly extending mounting flanges 26 which provide coplanar mounting surfaces 28. Near one end of the retainer 20 and on each flange 26 is provided a first boss 30 in the form of an elongated indentation which extends transversely thereof. The respective portion of each flange 26 having the boss 30 therein has a coplanar projection 32 extending inwardly to at least partially overlie the bar 24 thereby to retain the latter within the channel 22.

Immediately adjacent to the first boss 30 in each flange 26 is another boss 34 of circular shape, the height of the two bosses 30 and 34 above the mounting surface 28 being substantially equal as shown more clearly in FIG. 4. Each of the bosses 34 is provided with a hole 36 for receiving a threaded fastener therethrough. Two additional mounting holes 38 are provided in the opposite ends of the two flanges 26, respectively.

Laterally projecting stop abutments are provided on the opposite ends of the bar 24 in the form of, for example, a rivet 40 on one end and two projections 42 on the other end, these abutments being engageable with the opposite ends, respectively, of the retainer 20 thereby to prevent the slide bar 24 from being removed therefrom.

A hook-shaped finger pull 44 is provided on the outer end of the slide bar 24 as shown. Near the finger pull 44 and in the transverse portion of the slide bar 24 is threaded an adjusting screw 46 for a purpose which will be described hereinafter.

The slide device of this invention is mounted on a table as shown more clearly in FIG. 1. The retainer 20 is secured to the underside of the table top 10 by means of threaded fasteners 18 and 19 received by the respective mounting holes 36 and 38 in the flanges 26. While the mounting surfaces 28 of the flanges 26 at the left end portions (as shown in FIG. 1) have flush engagement with the underside of the table top, it will be noted that they are spaced therefrom by reason of the engagement of the first and second bosses 30 and 34. By reason of the boss 34 being formed around the respective mounting hole 36, the head of the threaded fastener 20 engages the inner side thereof to clamp the boss 34 against the underside of the table top without bending or distorting the respective flange 26. So mounted, the retainer 20 is inclined with the left end of the channel 22 (as shown in FIG. 1) being slightly elevated. This inclination tends to angle the slide bar 24 correspondingly such that the left end portion of the bar 24 will tend to have a firm, supporting engagement with the drop leaf 12 thereby to retain the latter forceably in a level position with the table top 10. The hinge connection 14 is so constructed that the adjoining edges of the top 10 and leaf 12 when engaged will dispose the upper surfaces of the top and leaf horizontally flush.

Should it develop that the outer end of the slide bar 24 when fully extended does not provide adequate upward support for the drop leaf, the adjusting screw 42 may be turned upwardly to a degree as will force the drop leaf into flush alignment with the table top. It will be understood that adjusting screw 42 may not be required in every case.

In operation, in order to hold the drop leaf 12 in an extended position flush with the table top 10, it is only necessary to grasp the finger pull 34 and slide the bar 24 outwardly to the position illustrated in FIG. 1. To release the drop leaf, it is only necessary to push the slide leaf 24 inwardly through the retainer 20 until the finger pull 44 is fully retracted to position 44*a*. This permits the drop leaf to drop downwardly to the dashed line position 12*a*.

By reason of the particular design of the retainer 20, it can be securely mounted, without deformation, to the underside of a table and inclined permanently to a position which will urge the slide bar when extended to a leaf elevating position. Should more elevating force be required, an adjusting screw is provided for the purpose.

While there have been described above the principles of this invention in connection with specific apparatus, it is to be clearly understood that this description is made only by way of example and not as a limitation to the scope of the invention.

What is claimed is:

1. A slide device for supporting the folding leaf of a drop-leaf table comprising an elongated bar, an elongated retainer channel having opposite ends which receives said bar for lengthwise reciprocation, said channel having oppositely extending coplanar flanges on opposite sides thereof which define a substantially flat mounting surface adapted to mount said channel on the underside of a tabletop, said bar having an upper surface spaced below said mounting surface, a first boss on each flange near one end of said channel which projects above said mounting surface, a second boss of substantially the same height above said surface as said first boss on each flange and disposed adjacent to said first boss on the side thereof toward the other end of said channel, each second boss having a first mounting hole therethrough and each said flange having a second mounting hole near said other end of said channel, said bar being movable between a retracted position substantially within said channel and an extended position extending outwardly from said other end of said channel for supporting the folding leaf in a horizontal position generally aligned with said table top.

2. The slide device of claim 1 wherein said retainer is formed of sheet metal and said bosses are indentations in said flanges.

3. The slide device of claim 1 further comprising means for retaining said bar assembled in said retainer.

4. The slide device of claim 3 wherein said retaining means includes inward extensions on said flanges which are coplanar therewith, said extensions at least partially overlying said bar in said channel.

5. The slide device of claim 4 wherein said retaining means further includes laterally extending abutments on the opposite ends of said bar, respectively, which are engageable with the opposite ends, respectively, of said channel.

6. The slide device of claim 1 including an adjusting element threaded through an end portion of said bar for engaging the underside of said dropleaf, said element being elongated and extending transversely of the plane of said flanges.

7. The slide device of claim 5 including a hook shaped portion on one end of said bar.

8. The slide device of claim 4 wherein said first boss is provided in said extensions and the adjoining portion of said flanges, said first boss being elongated and extending transversely of said flange.

9. The slide device of claim 8 wherein said channel has a depth slightly greater than the width of said bar.

* * * * *